US012234629B2

(12) United States Patent
Grover et al.

(10) Patent No.: US 12,234,629 B2
(45) Date of Patent: Feb. 25, 2025

(54) FLUSH VALVE AND TOILET ASSEMBLY

(71) Applicant: AS America, Inc., Piscataway, NJ (US)

(72) Inventors: David Grover, Stockton, NJ (US); Richard B. Sudol, Jr., Plainfield, NJ (US)

(73) Assignee: AS America, Inc., Piscataway, NJ (US)

( * ) Notice: Subject to any disclaimer, the term of this patent is extended or adjusted under 35 U.S.C. 154(b) by 119 days.

(21) Appl. No.: 18/024,003

(22) PCT Filed: Sep. 1, 2021

(86) PCT No.: PCT/US2021/048608

§ 371 (c)(1),
(2) Date: Feb. 28, 2023

(87) PCT Pub. No.: WO2022/051331

PCT Pub. Date: Mar. 10, 2022

(65) Prior Publication Data

US 2023/0265642 A1 Aug. 24, 2023

Related U.S. Application Data

(60) Provisional application No. 63/073,682, filed on Sep. 2, 2020.

(51) Int. Cl.

| | |
|---|---|
| ***E03D 1/14*** | (2006.01) |
| ***E03D 1/32*** | (2006.01) |
| ***E03D 1/35*** | (2006.01) |

(52) U.S. Cl.

CPC ..... *E03D 1/144* (2013.01); *E03D 1/32* (2013.01); *E03D 1/35* (2013.01)

(58) Field of Classification Search

CPC .. E03D 1/144; E03D 1/32; E03D 1/35; E03D 1/142; E03D 1/34

See application file for complete search history.

(56) References Cited

U.S. PATENT DOCUMENTS

| | | | | |
|---|---|---|---|---|
| 380,854 | A | 4/1888 | Boyle | |
| 423,022 | A | 3/1890 | Boyle | |
| 439,630 | A | 11/1890 | Boyle | |
| 3,705,428 | A * | 12/1972 | Braswell | E03D 1/34 4/402 |

(Continued)

OTHER PUBLICATIONS

PCT/US2021/048608 International Search Report, 2 pages, dated Dec. 13, 2021.

*Primary Examiner* — Christine J Skubinna
(74) *Attorney, Agent, or Firm* — Anna-lisa L. Gallo; Tyler A. Stevenson

(57) ABSTRACT

A toilet assembly comprising a toilet tank; a flush valve assembly positioned in the tank; a bowl; and a trapway, wherein the flush valve assembly comprises a flush valve body extending from a flush valve inlet to a flush valve outlet; a canister having a seal positioned at a lower end and a closed upper end; and a conduit positioned in an interior of the canister, wherein the seal is configured to enclose the flush valve inlet, the canister is configured to lift from the flush valve inlet to open the valve to initiate a flush cycle, the canister comprises one or more openings configured to provide flow communication between the canister and the tank, and the conduit is coupled to the trapway and provides for flow communication between the canister and the trapway.

20 Claims, 4 Drawing Sheets

(56) References Cited

U.S. PATENT DOCUMENTS

| | | | | |
|---|---|---|---|---|
| 5,142,712 | A | 9/1992 | Hennessy | |
| 7,010,816 | B2 | 3/2006 | Li | |
| 7,159,251 | B2 | 1/2007 | Hennessy | |
| 7,634,821 | B2 * | 12/2009 | Denzin | E03D 1/33 4/390 |
| 7,865,979 | B2 * | 1/2011 | Hand | E03D 1/145 4/399 |
| 8,141,179 | B2 | 3/2012 | Hennessy | |
| 8,196,231 | B2 | 6/2012 | Hennessy | |
| 8,266,732 | B1 | 9/2012 | Wang et al. | |
| 8,943,621 | B2 | 2/2015 | Wang | |
| 10,047,510 | B2 | 8/2018 | Cummings et al. | |
| 10,597,859 | B2 | 3/2020 | Hennessy et al. | |
| 2003/0229937 | A1 * | 12/2003 | Curtis | E03D 9/052 4/216 |
| 2016/0032575 | A1 | 2/2016 | Shinohara et al. | |
| 2017/0314246 | A1 | 11/2017 | Wagner | |
| 2021/0140162 | A1 | 5/2021 | Hennessy et al. | |

* cited by examiner

FLUSH VALVE AND TOILET ASSEMBLY

The disclosure relates to a flush valve assembly for a toilet, for example where the toilet is capable of providing a high energy flush with reduced flush water volumes.

BACKGROUND

Typically, toilets incorporate three systems that work together to perform the flushing action: a bowl siphon, a flush mechanism, and a refill mechanism. Working in concert, these three systems allow for and complete a flush cycle of a toilet. A tank, usually positioned over the back of the bowl, contains water that is used to initiate siphoning from the bowl to a sewage line, after which fresh water refills the bowl. When an operator desires to flush the toilet, he or she manipulates a flush lever on the outside of the tank, which is connected on the inside of the tank to a movable chain or lever. Upon operation, a flush lever moves a chain or lever on the tank interior, thereby lifting and opening a flush valve and causing water to flow from the tank and into the bowl initiate a toilet flush cycle.

In many toilet designs, water flows directly into the bowl and disperses into a bowl rim. The water releases into the bowl rather quickly, with flow from the tank into the bowl typically lasting approximately 2 to 4 seconds. The water flows from the rim, down a channel within the sides of the bowl and into a large hole at the bottom of the toilet (commonly known as a siphon jet). A siphon jet releases water into an adjoining siphon tube, thereby initiating a siphon action. A siphon action draws water and waste out of the bowl and into the siphon tube. Waste and water continues through the siphon tube and through a trapway and is released into a wastewater line. Once a tank is emptied of its contents during a flush, the flush valve closes, and a floating mechanism which has now dropped in the tank to some residual amount initiates opening of a fill valve. A fill valve provides fresh water to both the tank and the bowl through separate flows. Eventually the tank fills with water to a high enough level to cause the float to rise, thus shutting off the fill valve. At this point, a flush cycle is complete.

Excessive consumption of potable water remains a dilemma for water agencies, commercial building owners, homeowners, residents and sanitaryware manufacturers. An increasing global population has negatively affected the amount and quality of suitable water. In response to this global dilemma, many local and federal authorities have enacted regulations that reduce the water demand required by toilet flushing operations. In the United States, for instance, government agencies that regulate water usage have gradually reduced the threshold for fresh water use in toilets, from 7 gallons/flush (prior to the 1950s) to 5.5 gallons/flush (by the end of the 1960s) to 3.5 gallons/flush (in the 1980s). The National Energy Policy Act of 1995 now mandates that toilets sold in the United States can only use 1.6 gallons/flush (6 liters/flush). High-efficiency toilets that use 1.28 gallons per flush (gpf) or less can be certified under the EPA's WaterSense program.

Desired are low volume and/or high-efficiency toilets having a higher energy flush and a more powerful siphon.

SUMMARY

Accordingly, disclosed is a toilet assembly, comprising a toilet tank to hold flush water; a flush valve assembly positioned in the toilet tank; a toilet bowl; and a trapway in flow communication with the toilet bowl, wherein, the flush valve assembly comprises a flush valve body extending from a flush valve inlet to a flush valve outlet; a canister having a seal positioned at a lower end and a closed upper end; and a conduit positioned in an interior of the canister, wherein the seal is configured to enclose the flush valve inlet, the canister is configured to lift from the flush valve inlet to open the valve to initiate a flush cycle, the canister comprises one or more openings configured to provide flow communication between the canister and the toilet tank, and the conduit is coupled to the trapway and provides for flow communication between the canister and the trapway.

Also disclosed is a flush valve assembly comprising a flush valve body extending from a flush valve inlet to a flush valve outlet; a canister having a seal positioned at a lower end and a closed upper end; and a conduit positioned in an interior of the canister, wherein the seal is configured to enclose the flush valve inlet, the canister is configured to lift from the flush valve inlet to initiate a flush cycle, the canister comprises one or more openings configured to provide flow communication between the canister and a toilet tank, and the conduit is configured to couple to a toilet trapway and to provide flow communication between the canister and the trapway.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DISCLOSURE

Figure 1:
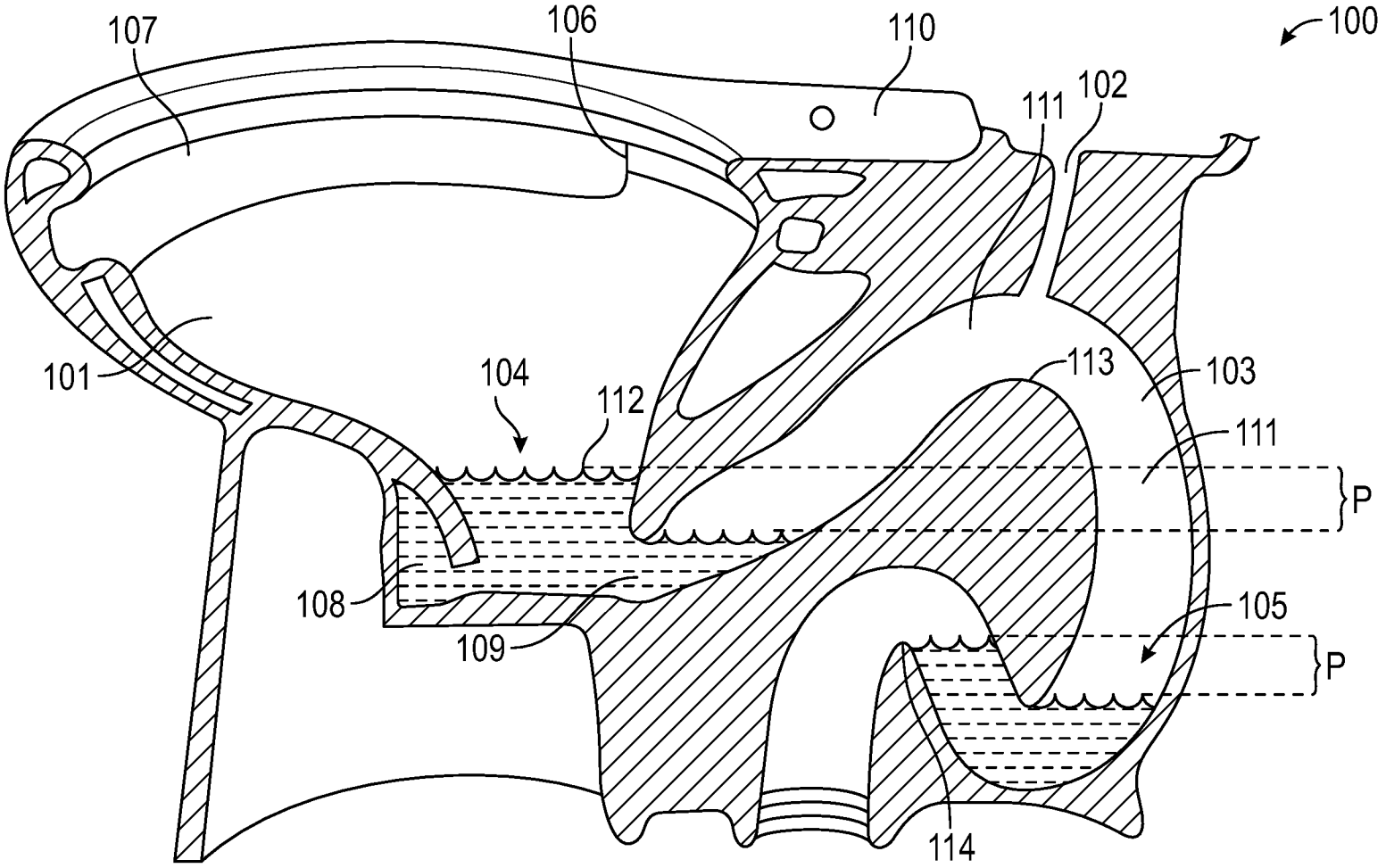
FIG. 1 shows a cross-section view of a toilet assembly, according to an embodiment.

FIG. 1 provides a cross-section view of toilet assembly 100, according to an embodiment. Shown are bowl 101, conduit 102, trapway 103, sump trap 104, and lower trap 105. Lower trap 105 is downstream of sump trap 104 and conduit 102 is coupled to trapway 103 at a position between lower trap 105 and sump trap 104. Also shown are rim outlet 106 and rim channel 107, and jet outlet 108 and trapway inlet 109. A toilet tank having a flush valve assembly positioned therein (not shown) may be positioned on toilet deck 110. With a flush valve assembly in a closed position, an air volume defined by a combined volume of an upper end of a flush valve assembly canister (not shown), conduit 102, and trapway portion 111 between sump trap 104 and lower trap 105 may be under a positive pressure. Trapway portion 111 may be defined as "portion between sump trap 104 and lower trap 105, meaning from a downstream water level of sump trap 104 to upstream water level of lower trap 105. A positive pressure P is shown, which may be from about 0.5 cm to about 5.0 cm of water above atmospheric pressure. Pressure P results in the presence of a larger water spot 112. Trapway 103 contains first weir 113 and second weir 114.

In some embodiments, a distance between an upper point of weir 114 and a lower point of trapway 103 represented by the fifth dashed line from the top of lower trap 105 may be from about 0.5 cm to about 5.0 cm. In some embodiments, this distance may be from any of about 0.2 cm, about 0.3 cm, or about 0.4 cm, to any of about 0.5 cm, about 0.6 cm, about 0.7 cm, about 0.8 cm, about 0.9 cm, or more. This distance may be termed "upper point of lower trapway wall to lower point of upper trapway wall" in reference to the lower trap.

In some embodiments, an air portion of a canister may have a volume of from any of about 15 mL, about 25 mL, about 50 mL, about 100 mL, about 125 mL, about 150 mL, about 175 mL, or about 200 mL, to any of about 225 mL, about 250 mL, about 275 mL, about 300 mL, about 350 mL, about 375 mL, or more. In some embodiments, a canister air portion volume compared to a an air volume defined by an upper end of the canister (the canister air portion), the conduit, and a portion of the trapway between the sump trap and lower trap, is from any of about 5%, about 10%, about 15%, about 17%, about 19%, about 22%, or about 25%, to any of about 28%, about 31%, about 33%, about 35%, or more.

Figure 2A:
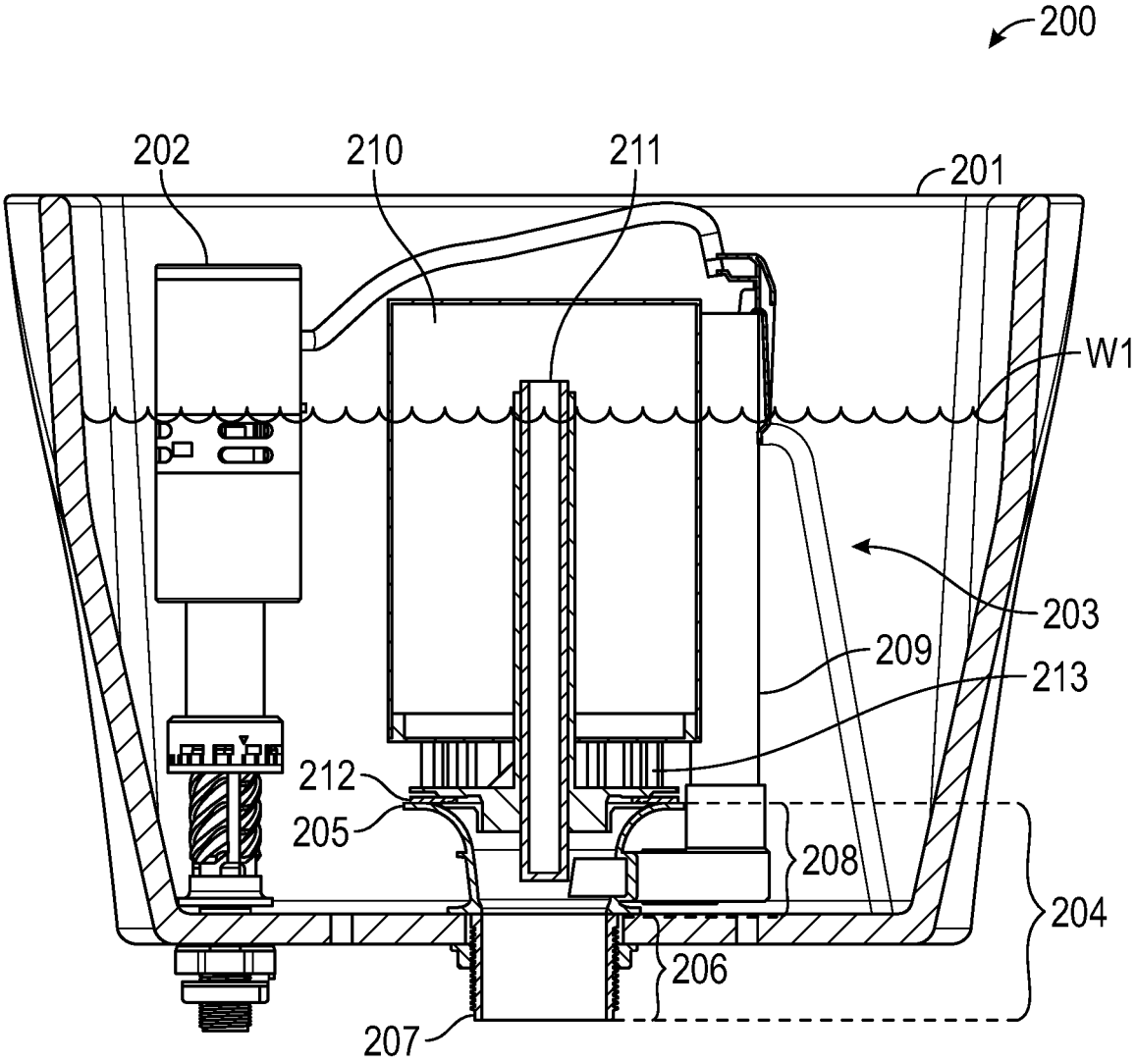
FIG. 2A provides a front, cross-section view of a toilet tank containing a flush valve assembly, according to an embodiment.

FIG. 2A shows a front, cross-section view of toilet assembly portion 200 comprising toilet tank 201 having refill valve 202 and flush valve assembly 203 positioned therein, in a closed position. Flush valve assembly 203 comprises flush valve body 204 having radiused inlet 205, annular base section 206 having outlet 207, and tapered section 208. Overflow tube 209 is coupled to tapered section 208. Canister 210 is substantially cylinder-shaped and contains conduit 211. An upper end of conduit 211 is positioned above a tank water level W1 when the tank if filled prior to a flush cycle. The upper end of canister 210 contains an air portion and a lower end of canister 210 contains a water portion. An air volume of a toilet assembly is defined by the canister air portion, conduit 211, and trapway section between a lower trap and sump trap (FIG. 1) when flush valve assembly 203 is in a closed position. The air volume may be under a positive pressure as shown in FIG. 1. Canister 210 comprises seal 212 at a lower end, the seal configured to enclose inlet 205 when valve assembly 203 is in a closed position as shown. Canister 210 contains a plurality of openings 213 positioned about a lower end thereof. Openings 213 provide fluid communication between the interior of canister 210 and tank 201. A total area of openings 213 is about equal to a total area of inlet 205.

Figure 2B:
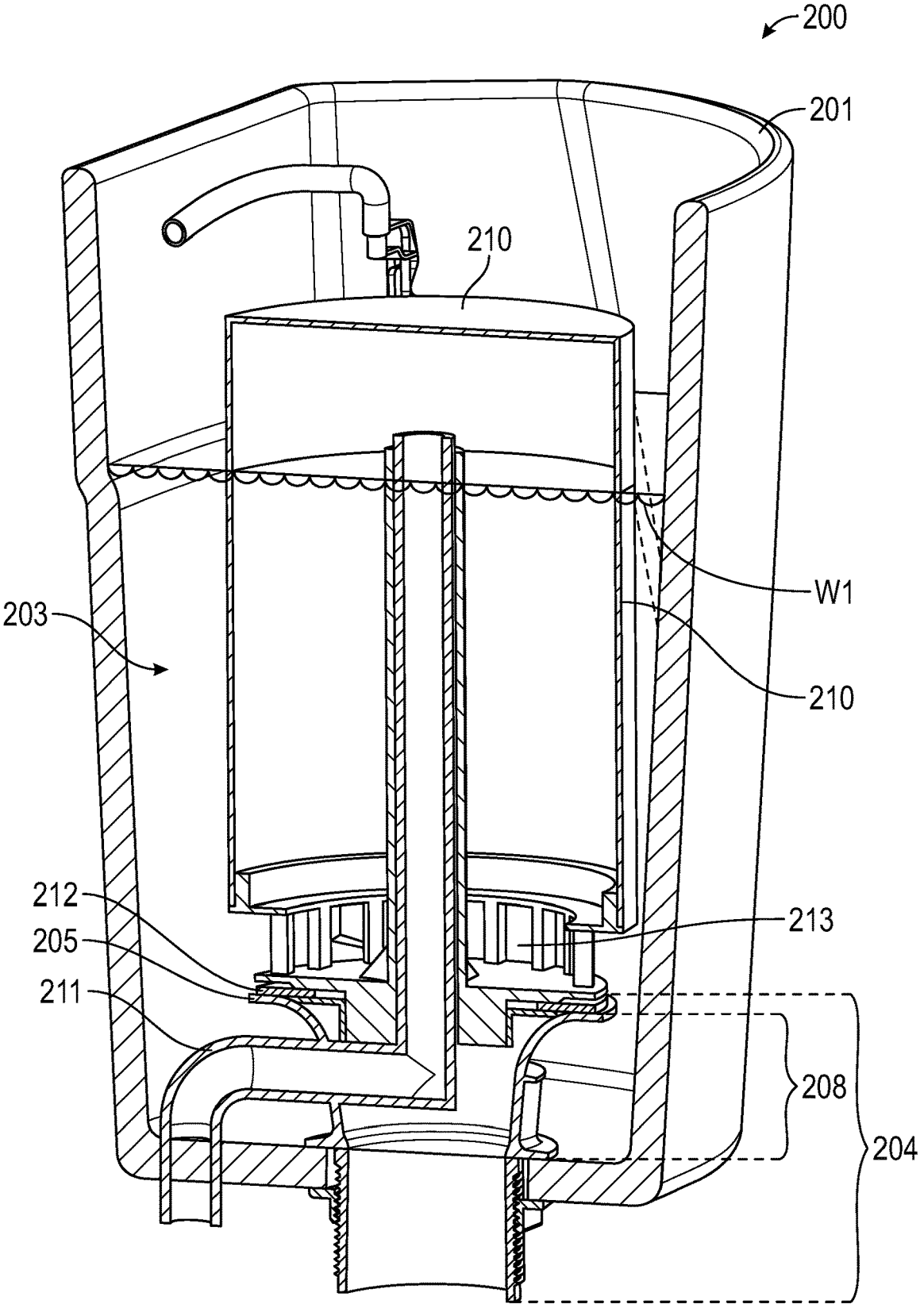
FIG. 2B provides a side, cross-section view of a toilet tank containing a flush valve assembly, according to an embodiment.

FIG. 2B shows a side, cross-section view of toilet assembly portion 200, with tank 201 containing flush valve assembly 203 in a closed position, according to an embodiment. Canister 210 contains a water level W1 and an air portion at an upper end thereof. An upper end of conduit 211 is positioned in the air portion of canister 210. Conduit 211 runs into valve body 204, out of valve body tapered section 208 and through the floor of tank 201. Conduit 211 is configured to couple to a trapway of a toilet assembly (FIG. 1).

Figure 2C:
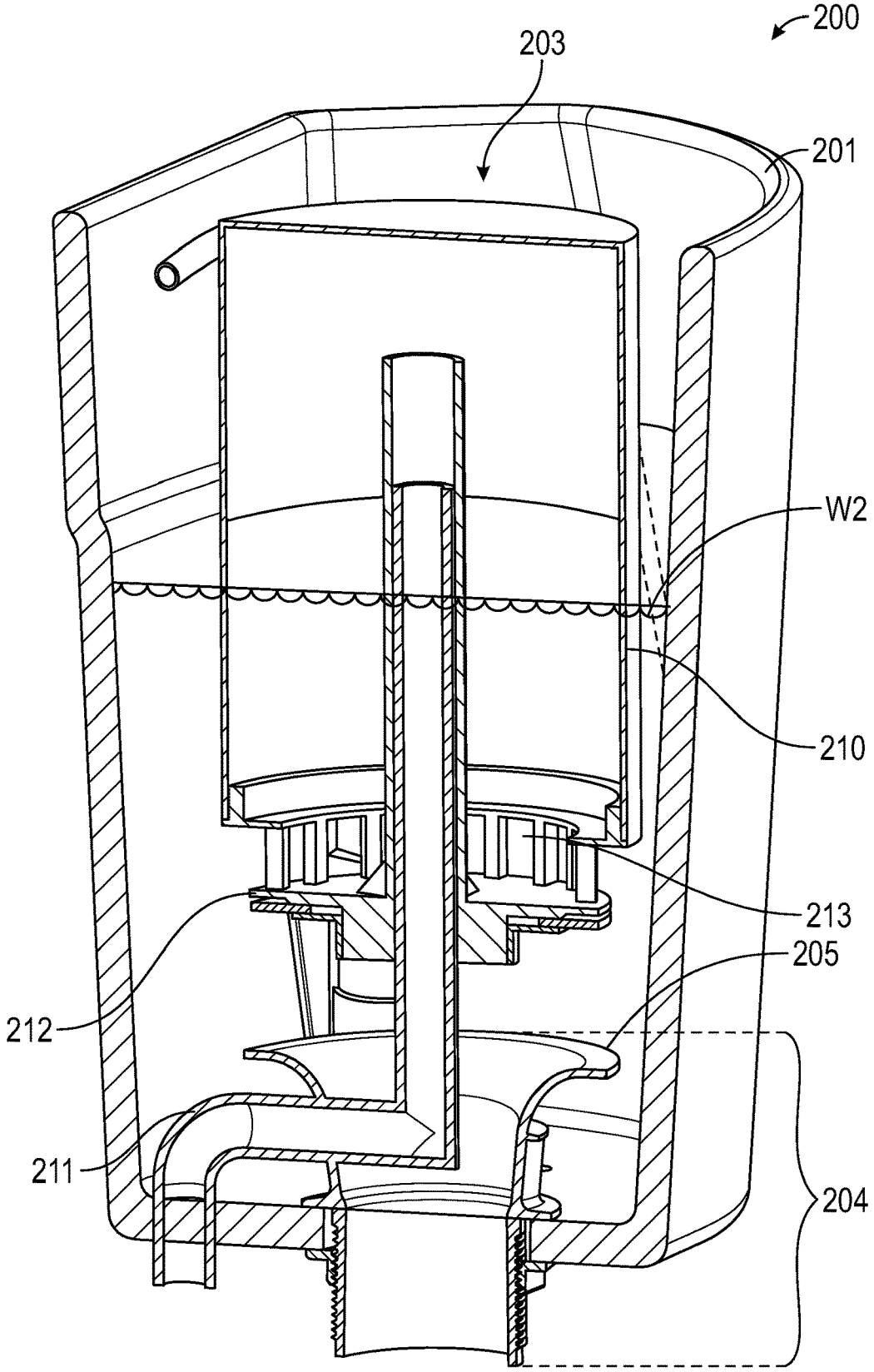
FIG. 2C shows a side, cross-section view of a toilet tank containing a flush valve assembly, according to an embodiment.

FIG. 2C shows a side, cross-section view of toilet assembly portion 200, with tank 201 containing flush valve assembly 203 in an open position, according to an embodiment. Canister 210 having seal 212 positioned at its lower end is lifted from flush valve inlet 205 to open valve assembly 203 to initiate a flush cycle. Toilet tank flush water flows through valve body 204 to a toilet bowl to initiate a siphon. As water flows out of tank 201 and canister 210 to lower level W2, pressure will drop in the air volume defined by the canister air portion, conduit 211, and a trapway section between a lower trap and sump trap (FIG. 1). A pressure drop will aid a siphon action to empty the bowl of water and waste. As flush valve assembly 203 is closed and toilet tank 201 is refilled with water to end a flush cycle, tank water re-enters canister 210 via plurality of holes 213. Re-entry of tank water into canister 210 will re-pressurize air in the air volume.

A toilet bowl comprises a rim extending at least partially around an upper perimeter of the bowl, an interior surface, and a sump area. A rim may define a rim channel extending from a rim inlet port and around an upper perimeter of the bowl and having at least one rim outlet port in fluid communication with an interior surface of the bowl. Fluid flow through a rim channel may serve to clean the bowl. In an embodiment, a bowl may have a rim shelf extending transversely along an interior surface of the bowl from a rim inlet port at least partially around the bowl so that fluid is configured to travel along the rim shelf and enter the bowl interior in at least one location displaced from the rim inlet port.

A bowl sump area is in fluid communication with a trapway inlet. A bowl sump area may define a sump trap. In some embodiments, a portion of an interior wall of the bowl in the sump area may be configured to upwardly incline from a jet outlet port toward the trapway inlet.

The sump area of the bowl in one embodiment has a sump trap defined by the interior surface of the bowl and having an inlet end and an outlet end, wherein the inlet end of the sump trap receives fluid from the jet outlet port and/or the interior area of the bowl and the outlet end of the sump trap is in fluid communication with the trapway inlet; and wherein the sump trap has a seal depth. An upper surface or uppermost point of the jet outlet port may be within the sump trap and positioned at a seal depth below an upper surface of the inlet to the trapway as measured longitudinally through the sump area. In some embodiments, a sump trap seal depth may be from any of about 1 cm, about 2 cm, about 3 cm, about 4 cm or about 5 cm to any of about 6 cm, about 7 cm, about 8 cm, about 9 cm, about 10 cm, about 11 cm, about 12 cm, about 13 cm, about 14 cm or about 15 cm or more.

In some embodiments, a toilet assembly may comprise a jet defining at least one jet channel, the jet channel extending from a jet inlet port in fluid communication with a flush valve to a jet outlet port positioned in a bowl sump area and configured for discharging fluid through the sump area to a trapway. In some embodiments, a jet channel, once primed with fluid, is capable of remaining primed before actuation of and after completion of a flush cycle.

A trapway is in fluid communication with a sump area of a toilet bowl and with a waste outflow line. In some embodiments, a trapway may have a shape defining a first upstream weir and a second downstream weir. A trapway may comprise a sump trap, the sump trap providing a bowl water spot. A trapway may also comprise a lower trap positioned downstream of a sump trap. A first upstream weir may be positioned in a trapway portion defined from a downstream water level of a sump trap to an upstream water level of a lower trap (between the sump trap and lower trap). In some embodiments, a conduit may be coupled to a trapway portion between the sump trap and lower trap. In some embodiments, a conduit may be coupled to a trapway at or near a first weir.

In some embodiments, a conduit portion coupled to a trapway may be integrally formed in chinaware, and may be configured to couple to a conduit portion of a flush valve assembly. In other embodiments, a conduit portion coupled to a trapway may comprise a thermoplastic. In some embodiments, a conduit running from a flush valve assembly to a trapway may be a unitary structure, or may comprise two or more separate segments coupled together. A conduit in total includes conduit portions from an upper end to a connection point at a trapway.

In some embodiments, a flush valve assembly comprises a canister having a seal positioned at a lower end thereof, and a closed upper end. A conduit portion is positioned at an interior of the canister. A conduit runs from the canister interior to a trapway, and provides flow communication between the canister interior and the trapway. In some embodiments, a canister may have one more openings positioned in a canister wall. In some embodiments, a canister may have one or more openings positioned towards a lower end thereof. In some embodiments, a canister may have a plurality of openings positioned at or near a lower end thereof.

In some embodiments, a total combined area of openings may be about equal to or greater than a total area of a valve inlet. In some embodiments, openings are located near, at, adjacent, or towards a valve seal when in a closed position. Openings may extend 360 degrees about a canister, thereby allowing water to flow out in all directions. Openings may extend about a canister in a symmetrical pattern. In some embodiments, a number of openings may be from any of 2, 3, 4, 5, 6, 7, 8, 9, or 10, to any of 11, 12, 13, 14, 15, 16, or more.

A flush valve assembly may comprise a flush valve body extending from a flush valve inlet to a flush valve outlet. In a closed position, a canister is positioned with a seal seated on and enclosing a flush valve inlet. In some embodiments, a seal may comprise an elastomer or other flexible polymer, for example flexible silicone or polyvinyl chloride.

In some embodiments, a flush valve body may comprise a radiused (rounded) fluid inlet. In some embodiments, a radiused flush valve inlet may have an outer diameter of from any of about 3.7 inches, about 3.8 inches, about 4.0 inches, about 4.2 inches, about 4.4 inches, or about 4.6 inches, to any of about 4.8 inches, about 5.0 inches, about 5.2 inches, about 5.4 inches, or more. In some embodiments, a radiused flush valve inlet may have an inner diameter of from any of about 2.6 inches, about 2.8 inches, about 3.0 inches, or about 3.2 inches, to any of about 3.4 inches, about 3.6 inches, about 3.8 inches, about 4.0 inches, or more.

In some embodiments, a flush valve body may comprise an annular base section having a fluid outlet. In some embodiments, an annular base section and fluid outlet may have an inner diameter of from any of about 2.4 inches, about 2.5 inches, about 2.6 inches, about 2.7 inches, about 2.8 inches, or about 2.9 inches, to any of about 3.0 inches, about 3.1 inches, about 3.2 inches, about 3.3 inches, about 3.4 inches, about 3.5 inches, about 3.6 inches, about 3.7 inches, about 3.8 inches, about 3.9 inches, about 4.0 inches, or more.

In some embodiments, a flush valve body may have a tapered portion, wherein a flush valve body inner diameter gradually decreases. In some embodiments, a flush valve body may comprise a tapered portion wherein the flush valve body inner diameter gradually decreases from a radiused fluid inlet to an annular base portion.

In some embodiments, when installed in a toilet tank, a flush valve body may extend from at or about at a toilet tank floor surface to a flush valve outlet. In other embodiments, when installed in a toilet tank, a flush valve body may extend from above a toilet tank floor surface to a flush valve outlet.

In some embodiments, a flush valve body may have an overflow tube coupled to it. In some embodiments, an overflow tube may be coupled to a flush valve body tapered section. An overflow tube may be in flow communication with the valve body. In some embodiments, a fill valve may be configured to provide fresh flush water to a bowl via an overflow tube after a flush has been performed.

In some embodiments, a canister may have a closed upper end. When a flush valve assembly is in a closed position prior to initiation of a flush cycle, a flush valve canister may contain a level of tank water at a lower end and an air portion at an upper end. In some embodiments, an upper end of a conduit is positioned in the air portion. In some embodiments, an upper portion of a flush valve assembly in a closed position will be positioned above a toilet tank water level. In some embodiments, a canister may contain essentially no air between flush cycles, or just enough air to cover an upper end of a conduit.

To initiate a flush cycle, an operator may manipulate a lever positioned on an outside of a toilet tank. The lever may be connected at a tank interior to a moveable chain or other linkage, which chain or linkage may be coupled to a top or side of a flush valve assembly canister. Upon operation of the lever, the chain or linkage may be configured to lift the flush valve assembly canister to open the flush valve and to pass flush water to a rim and/or jet of the toilet bowl. In other embodiments, a canister may be lifted via an electronic mechanism. A lift mechanism may be touchless.

A flush cycle is completed upon closing the flush valve and re-filling the toilet tank, a sump trap, and a lower trap. Upon completion of a flush cycle, new flush water entering the toilet tank also enters the canister via one or more openings positioned in a canister wall. Entry of water into the canister compresses air into a canister upper end, and may return an air volume defined by a canister upper end, a conduit, and a trapway portion between a sump trap and a lower trap to atmospheric pressure or a positive pressure above atmospheric. In some embodiments, a positive air pressure above atmospheric may be from any of about 0.5 cm of water, about 0.8 cm of water, about 1.1 cm of water, about 1.4 cm of water, about 1.7 cm of water, about 2.0 cm of water, about 2.3 cm of water, about 2.6 cm of water, or about 2.9 cm of water, to any of about 3.2 cm of water, about 3.5 cm of water, about 3.8 cm of water, about 4.1 cm of water, about 4.4 cm of water, about 4.7 cm of water, about 5.0 cm of water, or more.

Upon initiation of a flush cycle, as the canister is lifted from the flush valve to open it, flush water is discharged from the toilet tank and the canister through the flush valve. This exerts a negative pressure on the air volume defined by the canister upper end, conduit, and trapway portion between a sump trap and a lower trap. The negative pressure may mean a drop to atmospheric pressure or a partial vacuum. The negative pressure helps create a siphon to pull water and waste through the sump area and into and out of the trapway.

In some embodiments, a conduit may comprise a backflow preventer to prevent waste water from entering the conduit.

In some embodiments, a flush valve assembly canister may be substantially cylinder-shaped. In other embodiments, a canister may have other shapes, for example a box-like shape, a pyramid-like shape, a sphere- or spheroidal-like shape, an ovoid shape, a cone shape, an ellipsoid-like shape, partial shapes thereof, and the like.

A canister may comprise one or more openings positioned in a canister wall, configured to provide fluid communication between a canister interior space and a toilet tank. In some embodiments, a canister may comprise one or more openings positioned towards a lower end thereof. In some embodiments, a canister may comprise one or more openings positioned towards a lower end thereof and adjacent a seal.

In some embodiments, a toilet assembly is configured so that an inadvertent loss of air pressure in an air volume between flush cycles is prevented.

In some embodiments, a toilet assembly may be configured for an operator to choose for instance a "full flush" of about 1.6 gallons (about 6 liters) of water to eliminate solid waste or a "partial flush" (short flush) of a lower volume or water, for example about 1.1 gallons (about 4 liters), for the removal of liquid waste. A choice of flush volume may depend on a canister lift height and/or valve open time.

The term "adjacent" may mean "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled". The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A toilet assembly, comprising
a toilet tank to hold flush water;
a flush valve assembly positioned in the toilet tank;
a toilet bowl; and
a trapway in flow communication with the toilet bowl,
wherein, the flush valve assembly comprises
a flush valve body extending from a flush valve inlet to a flush valve outlet;
a canister having a seal positioned at a lower end and a closed upper end; and
a conduit positioned in an interior of the canister,
wherein
the seal is configured to enclose the flush valve inlet,
the canister is configured to lift from the flush valve inlet to open the valve to initiate a flush cycle,
the canister comprises one or more openings configured to provide flow communication between the canister and the toilet tank, and
the conduit is coupled to the trapway and provides flow communication between the canister and the trapway.

2. The toilet assembly according to claim 1, wherein the trapway comprises a sump trap and a lower trap, and wherein the conduit is coupled to the trapway at a position between the sump trap and the lower trap.

3. The toilet assembly according to claim 2, wherein, when the flush valve is in a closed position, the toilet assembly comprises an air volume defined by an upper end of the canister, the conduit, and a portion of the trapway between the sump trap and the lower trap.

4. The toilet assembly according to claim 3, wherein, when the flush valve is in a closed position, the canister contains a toilet tank water portion and an air portion.

5. The toilet assembly according to claim 4, wherein an upper end of the conduit is configured to be positioned in the air portion.

6. The toilet assembly according to claim 4, wherein, upon lifting the canister and opening the flush valve to initiate a flush cycle, reduced pressure is created in the air volume.

7. The toilet assembly according to claim 4, wherein, upon lowering the canister to close the flush valve, and re-filling the toilet tank with water to end a flush cycle, increased pressure is created in the air volume.

8. The toilet assembly according to claim 7, wherein when the flush valve assembly is in the closed position, the air volume is under a positive pressure of from about 0.5 cm to about 5.0 cm of water above atmospheric pressure.

9. The toilet assembly according to claim 1, wherein the one or more openings are positioned towards a lower end of the canister.

10. The toilet assembly according to claim 1, wherein the one or more openings are positioned adjacent a lower end of the canister.

11. The toilet assembly according to claim 1, wherein the canister comprises a cylinder shape.

12. The toilet assembly according to claim 1, wherein the conduit comprises a backflow preventer.

13. A flush valve assembly comprising
a flush valve body extending from a flush valve inlet to a flush valve outlet;
a canister having a seal positioned at a lower end and a closed upper end; and a conduit positioned in an interior of the canister, wherein the seal is configured to enclose the flush valve inlet, the canister is configured to lift from the flush valve inlet to initiate a flush cycle, the canister comprises one or more openings configured to provide flow communication between the canister and a toilet tank, and the conduit is configured to couple to a toilet trapway and to provide flow communication between the canister and the trapway.

14. The flush valve assembly according to claim 13, wherein the flush valve body comprises a radiused fluid inlet, an annular base section, and a tapered inner diameter that decreases from the radiused fluid inlet to the annular base section.

15. The flush valve assembly according to claim 14, wherein upon installation of the assembly in a toilet tank, the annular base extends from about a toilet tank floor to the flush valve outlet.

16. The flush valve assembly according to claim 14, wherein upon installation of the assembly in a toilet tank, the annular base extends from above a toilet tank floor to the flush valve outlet.

17. The flush valve assembly according to claim 13, wherein an overflow tube is coupled to the flush valve body.

18. The flush valve assembly according to claim 17, wherein the overflow tube is coupled to the flush valve body at the tapered section.

19. The flush valve assembly according to claim 13, wherein the canister is substantially cylinder-shaped.

20. The flush valve assembly according to claim 13, wherein the canister comprises from 2 to about 16 openings.

* * * * *